US011986695B2

(12) United States Patent
Jones

(10) Patent No.: US 11,986,695 B2
(45) Date of Patent: May 21, 2024

(54) EXERCISE GRIP

(71) Applicant: William Jones, Rochester, MN (US)

(72) Inventor: William Jones, Rochester, MN (US)

( * ) Notice: Subject to any disclaimer, the term of this patent is extended or adjusted under 35 U.S.C. 154(b) by 0 days.

(21) Appl. No.: 17/468,818

(22) Filed: Sep. 8, 2021

(65) Prior Publication Data

US 2022/0126162 A1 Apr. 28, 2022

Related U.S. Application Data

(60) Provisional application No. 63/105,888, filed on Oct. 27, 2020.

(51) Int. Cl.
*A63B 21/00* (2006.01)

(52) U.S. Cl.
CPC ..... *A63B 21/4035* (2015.10)

(58) Field of Classification Search
CPC ..... A63B 21/4035; A63B 21/0552; A63B 21/0557
See application file for complete search history.

(56) References Cited

U.S. PATENT DOCUMENTS 5,722,117 A * 3/1998 Nielsen ..... B29C 61/00 294/171
D403,035 S * 12/1998 MacPherson ..... D21/684
6,183,400 B1 * 2/2001 Pope ..... A63B 21/4019 74/551.8
6,604,789 B1 * 8/2003 Downing ..... A47C 31/11 5/663
D616,950 S * 6/2010 Hersee ..... D8/303
7,736,284 B1 * 6/2010 Andrews ..... A63B 21/072 482/92
D688,338 S * 8/2013 Bisson ..... D21/694
D721,773 S * 1/2015 Marooth ..... D21/694
D739,484 S * 9/2015 Kaye ..... D21/694
9,480,367 B2 * 11/2016 Reed ..... F16M 13/02
D867,492 S * 11/2019 Didia ..... D21/694
11,033,774 B1 * 6/2021 Clarke ..... A63B 21/00185
11,266,870 B2 * 3/2022 Leadbetter ..... A63B 21/0724
D958,272 S * 7/2022 Leclair ..... D21/694
2002/0072455 A1 * 6/2002 Akins ..... A63B 21/0783 482/109
2006/0052223 A1 * 3/2006 Terry ..... A63B 23/03525 482/121
2009/0197742 A1 * 8/2009 Hartman ..... A63B 21/026 482/92
2009/0275447 A1 * 11/2009 Fishman ..... A63B 21/072 482/139
2009/0275448 A1 * 11/2009 Fishman ..... A63B 21/072 482/139

(Continued)

*Primary Examiner* — Andrew S Lo
(74) *Attorney, Agent, or Firm* — Andrew Morabito

(57) ABSTRACT

An exercise handle, comprising: a housing having a slot extending from a first end to a second end and an internal cavity; a sleeve having a slot extending from a first end to a second end; and a retainer having a slot extending from a first end to a second end; wherein the retainer is secured to the sleeve wherein the slots align and an internal cavity is formed and the retainer and sleeve assembly is inserted into the internal cavity of the housing and the sleeve retainer assembly is able to rotate within the housing so that the housing slot is able to align with the sleeve retainer assembly slot.

6 Claims, 8 Drawing Sheets

(56) References Cited

U.S. PATENT DOCUMENTS

| | | | | |
|---|---|---|---|---|
| 2010/0197470 | A1* | 8/2010 | Hartman | A63B 23/16<br>482/139 |
| 2012/0208683 | A1* | 8/2012 | Hartman | A63B 23/12<br>482/139 |

* cited by examiner

EXERCISE GRIP

CROSS-REFERENCE TO RELATED APPLICATIONS

This application is a continuation (and claims the benefit of priority under 35 USC 120) of U.S. application No. 63/105,888 filed Oct. 27, 2020. The disclosure of the prior applications is considered part of (and is incorporated by reference in) the disclosure of this application.

BACKGROUND OF THE INVENTION

The present invention relates to an exercise grip, and more particularly to a lockable exercise grip.

Resistance bands are popular pieces of strength training equipment that allow individuals to build and tone their muscles with a simple elongated strap. Most resistance bands are made from a durable rubber strap or an elongated piece of elastic able to withstand repeated stretching and relaxing. Many people enjoy the convenience of utilizing the bands because they are easy to store, and transport compared to conventional strengthening pieces like barbells, kettlebells or hand weights. Because they are basically a flexible, elongated strap, tubular bands, and close-loop bands, people can easily take the bands wherever they go for an instant workout.

Some resistance bands include a handle to pull and release the strap. The handle allows the user to attach one end to a static structure and then hold the handle at the other end. This allows the users to manipulate the band back and forth while grasping the handle. While the handle is more convenient for the user than simply using the band, the handles do not allow for functional movements like kicks, punches or large swinging arm and leg movements. The user must continuously grasp the handle otherwise risk injury to themselves or surrounding items if control is lost in grip.

However, many resistance bands do not have a handle or grip, and thus the person has to hold them in their hand. For many people this is uncomfortable or interferes with their exerciser. Additionally, in the resistances bands with the built-in handle, if the handle breaks the entire band becomes useless and the person needs to buy a new one.

The present invention provides a solution to this problem by creating an easily removable handle or grip for resistance band training.

SUMMARY

Accordingly, in a first embodiment, the present invention is an exercise handle, comprising: a housing having a slot extending from a first end to a second end and an internal cavity; a sleeve having a slot extending from a first end to a second end; and a retainer having a slot extending from a first end to a second end; wherein the retainer is secured to the sleeve wherein the slots align and an internal cavity is formed and the retainer and sleeve assembly is inserted into the internal cavity of the housing and the sleeve retainer assembly is able to rotate within the housing so that the housing slot is able to align with the sleeve retainer assembly slot.

Accordingly, in a second embodiment, the present invention is an exercise handle, comprising: a housing having a slot extending from a first end to a second end and an internal cavity; a sleeve having a slot extending from a first end to a second end and a locking tab extending from the first end, wherein the sleeve is inserted into the housing, and is rotatable about a central axis of the housing and the locking tab is sized to fit within the slot of the housing and.

DETAILED DESCRIPTION OF THE INVENTION

Figure 1:
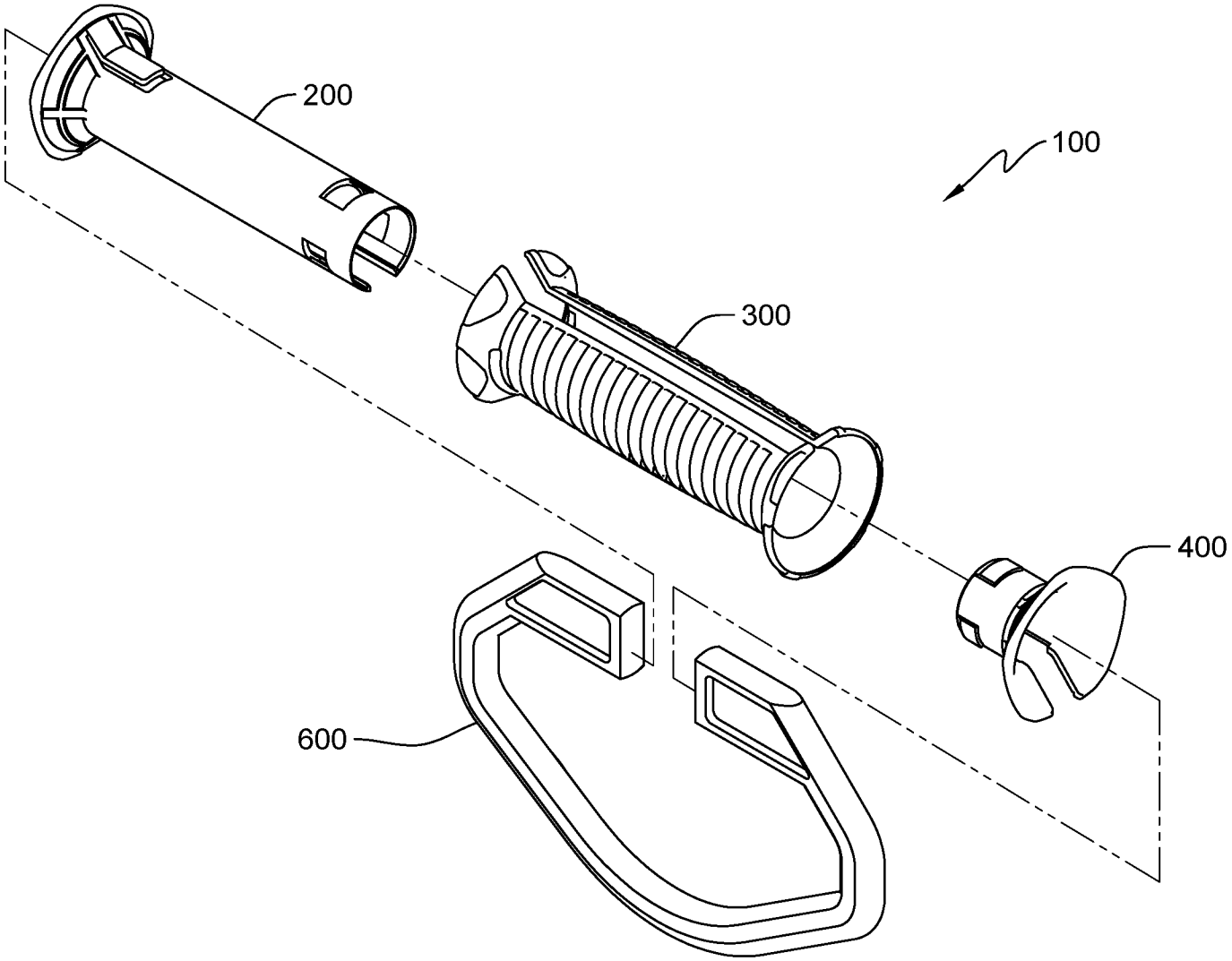
FIG. 1 depicts an exploded view of the handle, in accordance with one embodiment of the present invention.

The present invention provides a device that allows for a more comfortable work out when using bands (e.g., resistance bands, strap, tubular strap, close loop strap, etc.), cable machine, or the like. The present invention provides an easily attachable and removable grip that can be used to provide a more comfortable grip on the band or cable, and a more secure and stable grip as well. This provides an increased level of comfort for the person. As well as with the variety of designs of the grips and/or handles for a variety of workouts which were previously unavailable to people using resistance bands for training purposes only. This is advantageous because with the ability to quickly attach and remove the handle, the user is able to perform exercises they would normally perform in a more comfortable and safe manner as well. The user is able to keep their previously purchased bands or cables, and even allow for the ability to stack bands to create a higher resistance workout as well.

As will be apparent to those of skill in the art upon reading this disclosure, each of the individual embodiments described and illustrated herein has discrete components and features which may be readily separated from or combined with the features of any of the other several embodiments without departing from the scope or spirit of the present invention. It is to be understood that this invention is not limited to particular embodiments described, as such may, of course, vary. It is also to be understood that the terminology used herein is for the purpose of describing particular embodiments only, and is not intended to be limiting, since the scope of the present invention will be limited only by the appended claims.

Unless defined otherwise, all technical and scientific terms used herein have the same meaning as commonly understood by one of ordinary skill in the art to which this invention belongs. Although any methods and materials similar or equivalent to those described herein can also be used in the practice or testing of the present invention, the preferred methods and materials are now described.

All publications and patents cited in this specification are herein incorporated by reference as if each individual publication or patent were specifically and individually indicated to be incorporated by reference and are incorporated herein by reference to disclose and describe the methods and/or materials in connection with which the publications are cited. The citation of any publication is for its disclosure prior to the filing date and should not be construed as an admission that the present invention is not entitled to antedate such publication by virtue of prior invention. Further, the dates of publication provided may be different from the actual publication dates which may need to be independently confirmed.

It must be noted that as used herein and in the appended claims, the singular forms "a", "an", and "the" include plural referents unless the context clearly dictates otherwise. It is further noted that the claims may be drafted to exclude any optional element. As such, this statement is intended to serve as antecedent basis for use of such exclusive terminology as "solely," "only" and the like in connection with the recitation of claim elements or use of a "negative" limitation.

Figure 2:
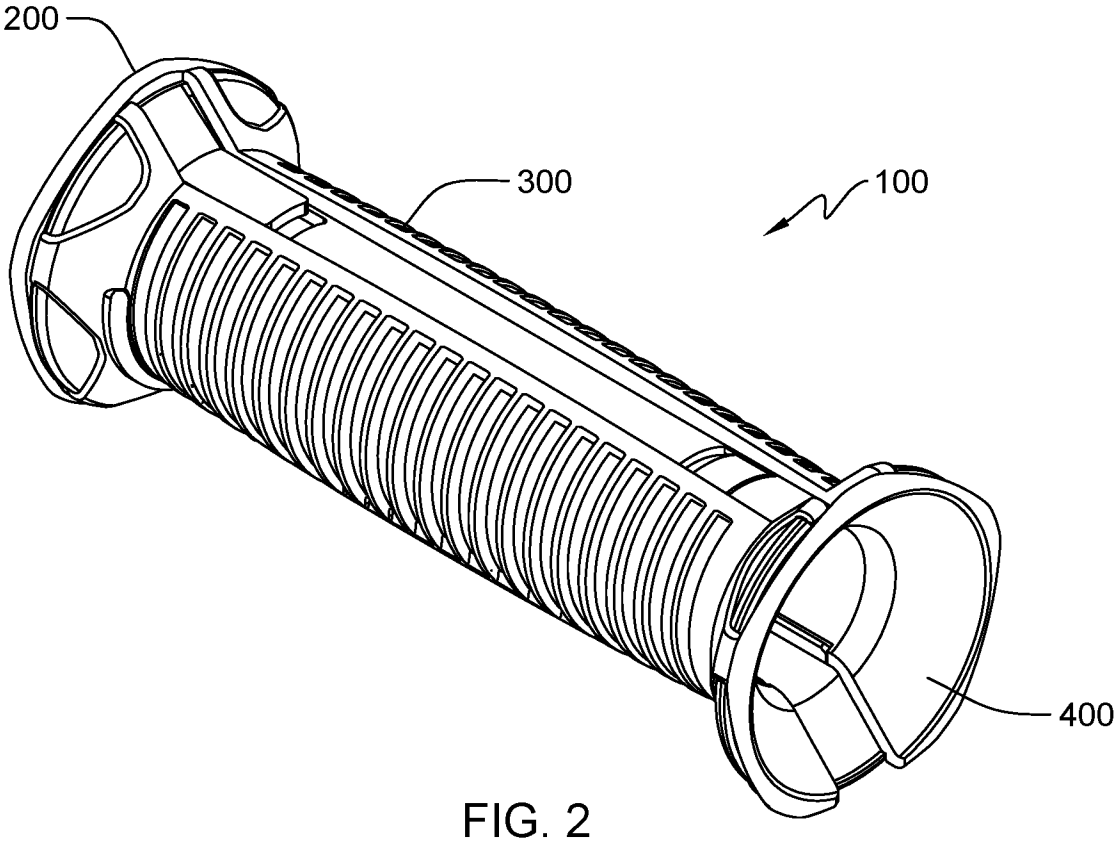
FIG. 2 depicts an isometric view of a handle in an unlocked, in accordance with one embodiment of the present invention.
Figure 3:
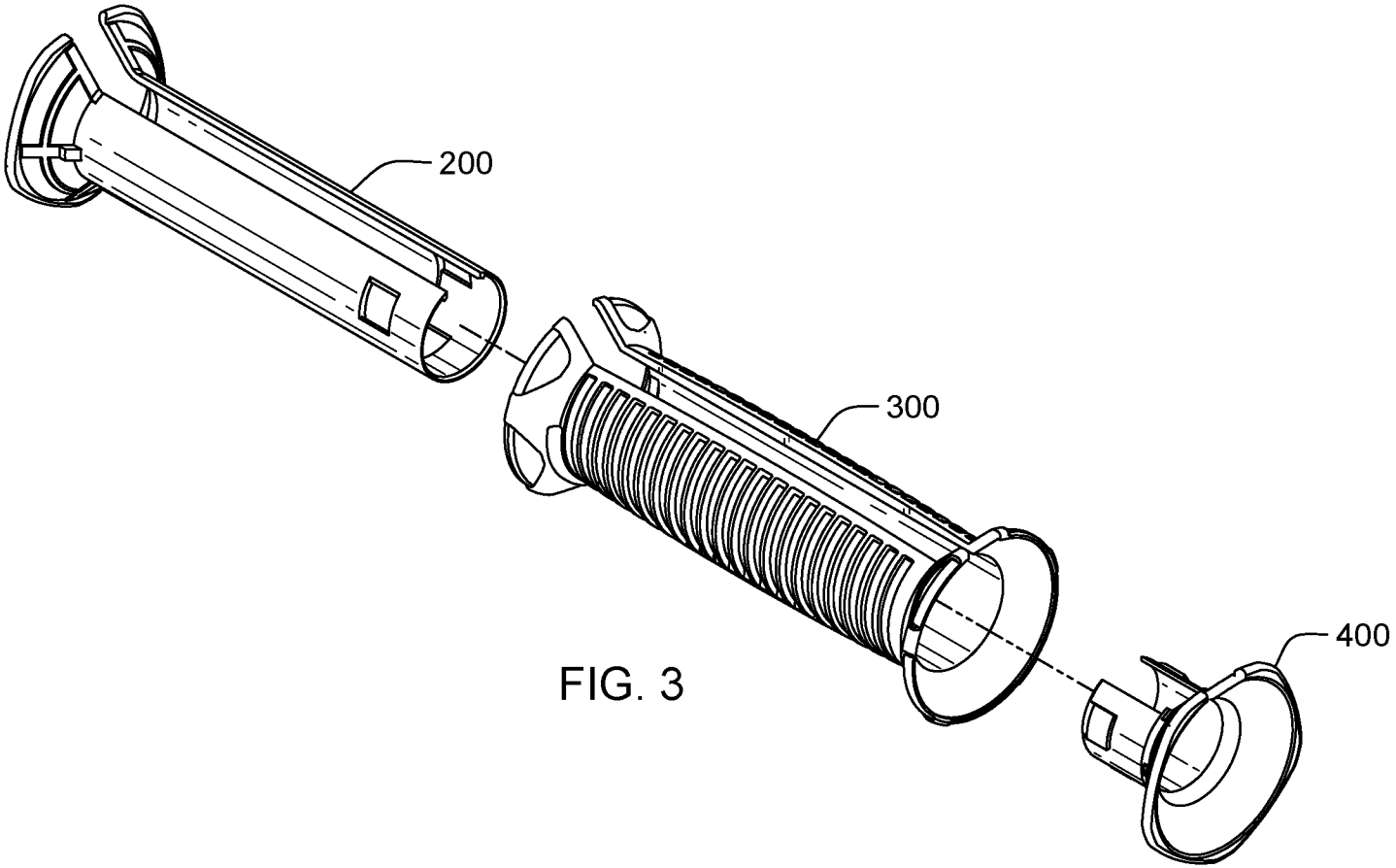
FIG. 3 depicts an exploded view of a handle in an unlocked, in accordance with one embodiment of the present invention.

FIGS. 1-3 depict views of an exercise handle 100 in an exploded view, a locked view and an unlocked view respectively, in accordance with one embodiment of the present invention. The exercise handle 100 is comprised of a sleeve 200, a housing 300, and a retainer 400. In some embodiments a grip 600 is inserted into the handle 100 to allow for the connection of additional bands or oversized bands.

Figure 8:
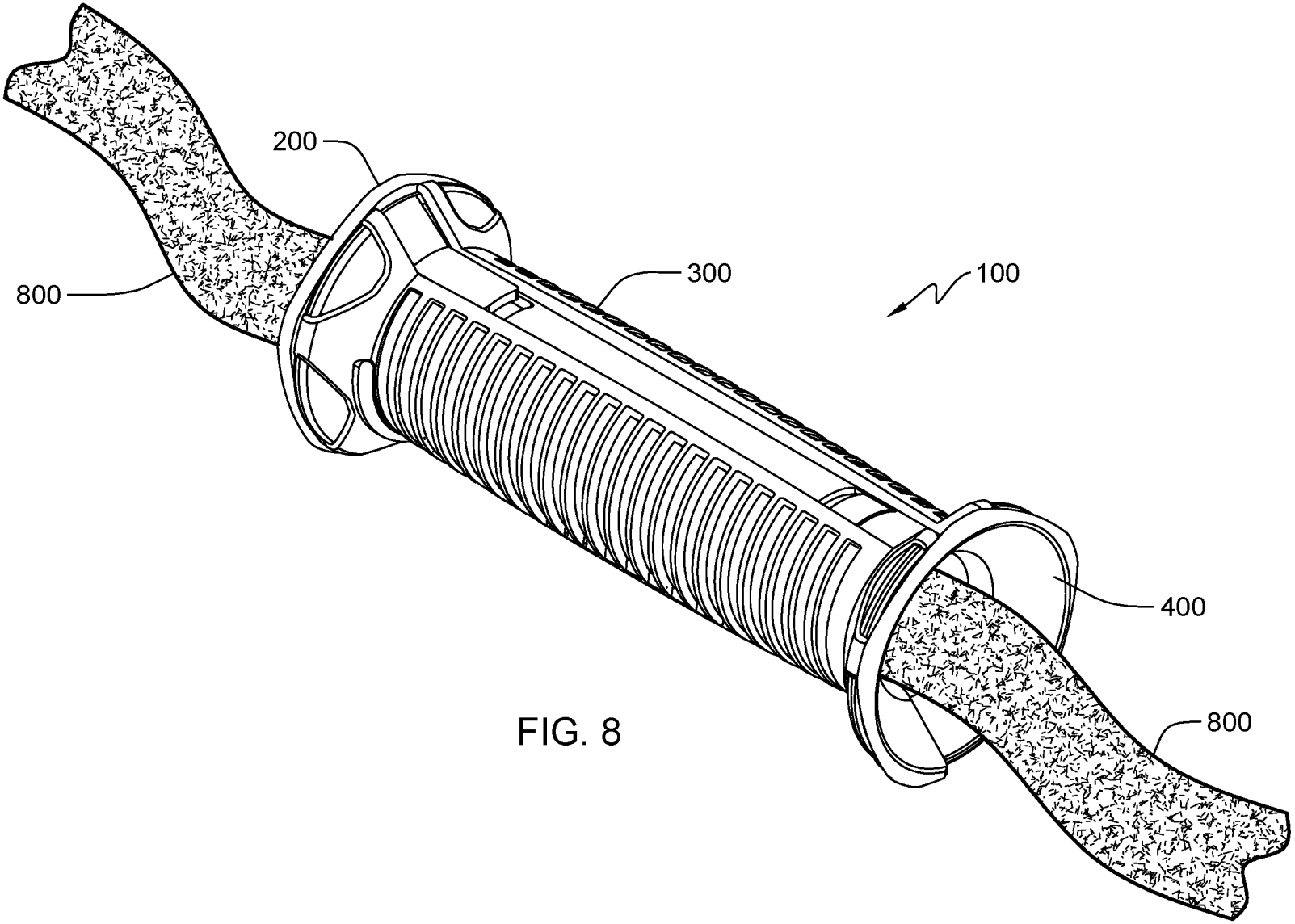
FIG. 8 depicts a view of the handle in a locked position, in accordance with one embodiment of the present invention.

As shown the sleeve 200 and the retainer 400 form a handle with a channel that extends entirely through the formed handle to allow a band (exercise band, rubber band, or the like) to be interested into the handle. As shown in FIG. 8, a band 800 passes through the core of the exercise handle 100. This allows the exercise handle 100 to travel along the band 800 (or bar) with little to no resistance and allow the user to position the exercise handle 100 in a positioned along the band 800 that is ideal for the exercise or work out being performed. In some embodiments, the band 800 is a metal bar or other rod which is sized to fit within the core of the exercise handle 100. The sleeve 200 fits around the formed handle, and when rotated a locking tab on the formed handle secures the sleeve 200 in place so that the band which was inserted into the handle is secured in the inner hollow portion of the handle, and the channel is covered by the sleeve. The provides an advantage of allowing for a safer operation where a band cannot slip out of the exercise handle 100, and the bands are easy to replace or change.

Figure 4:
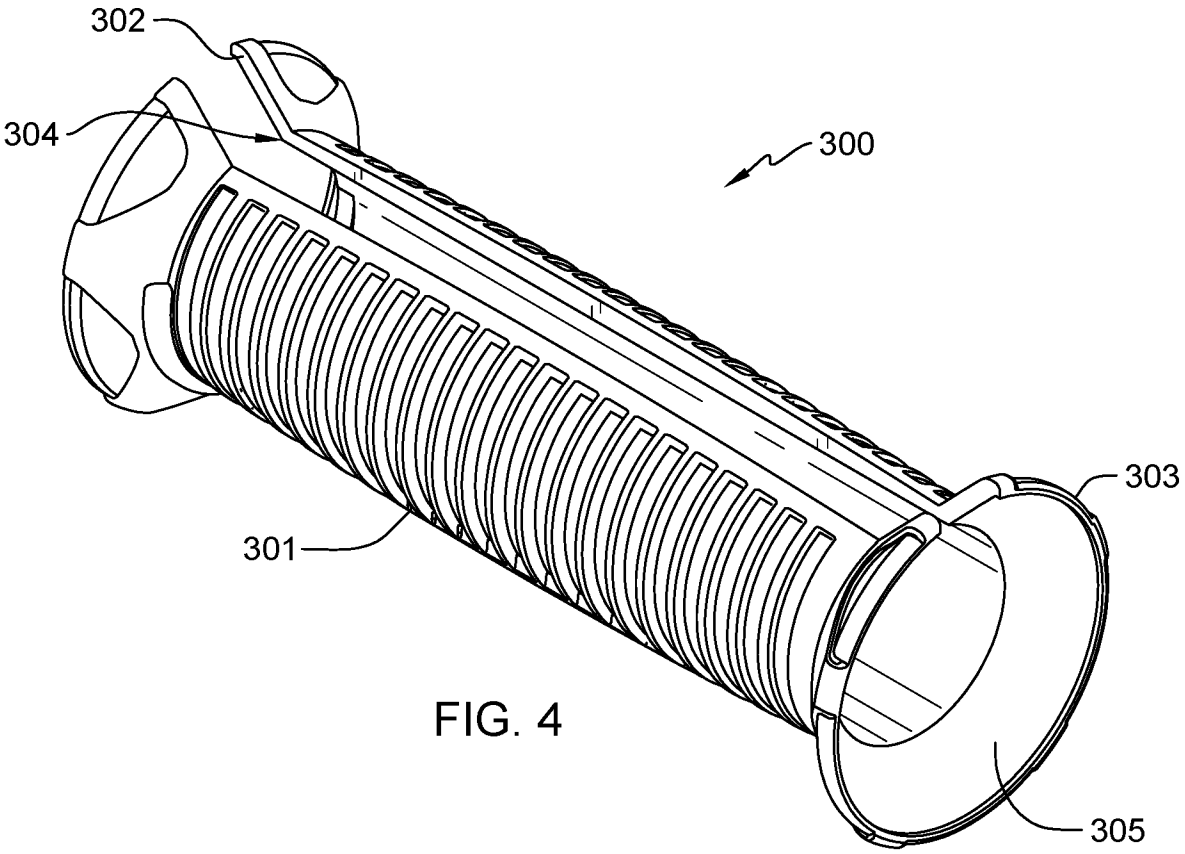
FIG. 4 depicts an isometric view of a sleeve, in accordance with one embodiment of the present invention.

The housing 300 is shown in FIG. 4 in accordance with one embodiment. The housing 300 is a cylindrical hollow tube 301 with extended ends 303 and has a channel 304 which extends the entire length of the housing 300. The extended ends 303 are designed to assist in keeping the user's hand centered on the handle 100 and act as a wall or guard to keep their hand from slipping off the handle 100. These extended ends 303 are of a predetermined height, curvature, and angle to ergonomically fit the user's hands. The channel 304 is of a predetermined with, similar to that of the sleeve 200 and the retainer 400. The extended ends 303 have an inner surface 305 which is designed to receive the sleeve 200 and the retainer 400 and provides a low friction surface for the sleeve 200 and retainer 400 to rest against. The exterior surface of the housing has a design and contour to provide improved grip for the user. The extensions 303 are similar in size and shape to the extension 202 of the sleeve and of an extension 402 of the retainer 400. The housing 300 has an exterior surface 308 that has a grip like design to create an ergonomic surface for the user. In some embodiments, this is a smooth surface, and may be made from various materials such as rubber or foam to create an ergonomic and comfortable design for the user. The extensions 303 extend outwards and upwards to create "walls" to assist the user in keeping their hand from slipping off the handle 100 and give them a surface to position their hands against based on the workout/exercise they are performing. When in use, the housing 300 will tighten slighting by the force applied by the user's hand to provide additional securement around the band or bar. By allowing the housing 300 to flex, it means that when the user is applying tension or pressure to the housing 100 by gripping it, the housing 300 with tighten around the sleeve 200. The housing 300 has a textured surface to provide additional grip. The pattern of the texture is modifiable and not limited to just the design shown in the figures.

Figure 5:
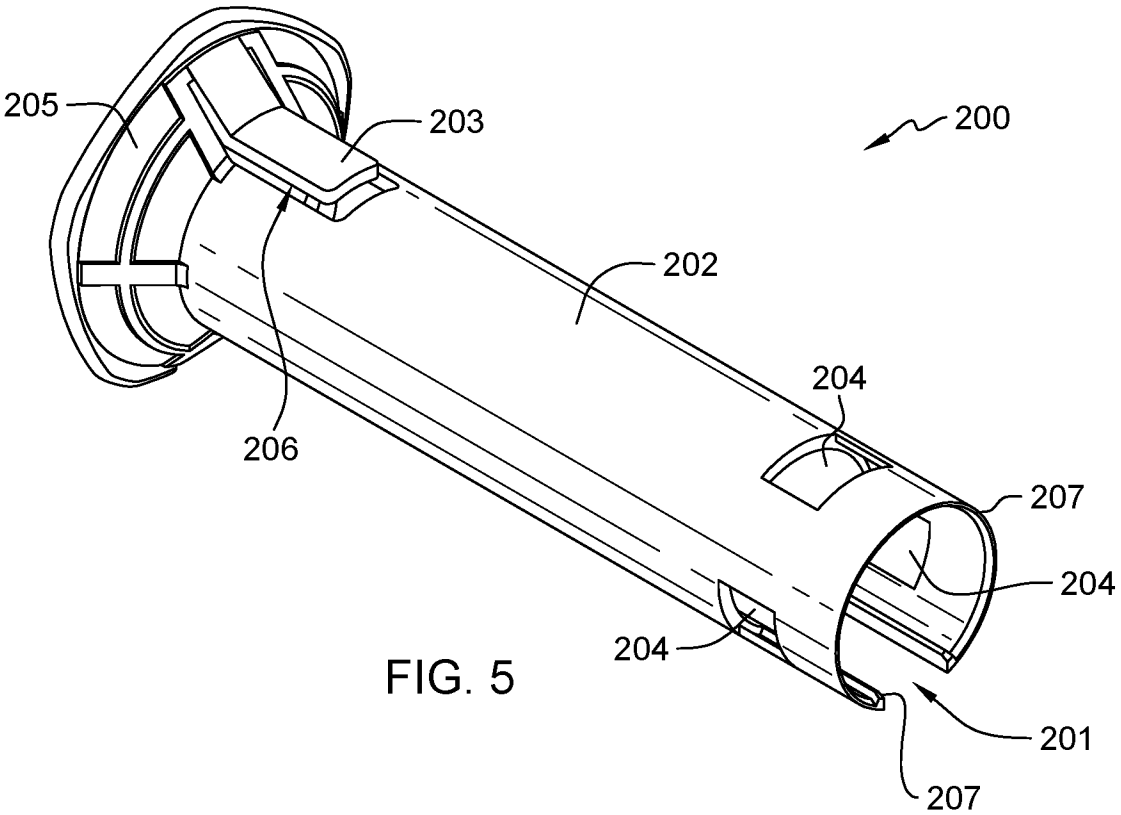
FIG. 5 depicts an isometric view of a housing, in accordance with one embodiment of the present invention.

The sleeve 200 is shown in FIG. 5, in accordance with one embodiment of the present invention. The sleeve 200 has a cylindrical core 202 section which is approximately the same length as the housing 300. On one end of the sleeve 200 are a series of apertures 204 of a predetermined size, and shape, and distal to a first end 207. At a second end 205 the sleeve 200 has an extension which extends outwards and is similar to the extensions 303 of the housing 300. A release tab 203 is integrated into the second 205 and is opposite of a channel 201. The release tab 203 is a predetermined width, that is the same as the channel 304 of the housing 300 so that the release tab 203 will fit within the channel 304. The channel 201 extends from the first end 205 to the second end 206. The release tab 203 is pressure sensitive, and when pressed the sleeve 200 is able to rotate within the housing 300. Given that the release tab 203 is pressure sensitive, when the sleeve 200 rotates within the housing 300, when the release tab 203 aligns with the slot 304, the release tab 203 engages itself, to "lock" the sleeve 200 in place. This is a safety feature which is advantageous to keep the band 800 or whatever piece of equipment is extending through the sleeve 200 secured within the exercise handle 100. In additional embodiments, the release tab 203 may be integrated into the cylindrical core 202 of the sleeve 200 or other parts of the sleeve 200 provided it is not interfering with the channel 201.

Figure 6:
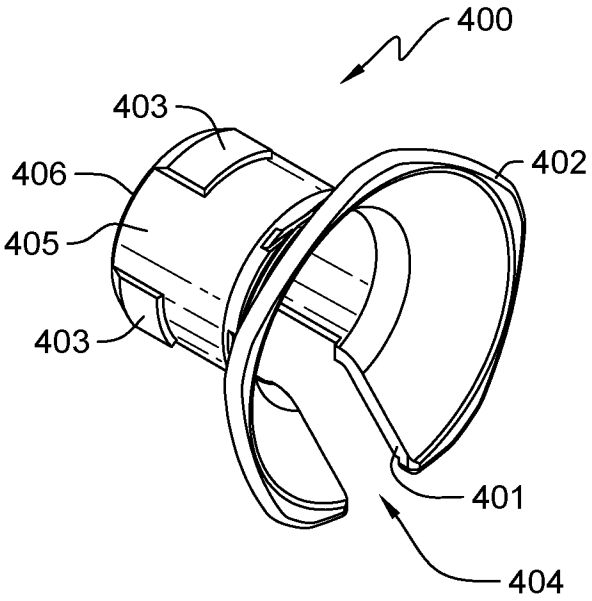
FIG. 6 depicts an isometric view of a retainer, in accordance with one embodiment of the present invention.

The retainer 400 is shown in FIG. 6, in accordance with one embodiment of the present invention. The retainer 400 has a hollow cylindrical section 405 with an extension 402 similar to that of the sleeve 200 and the housing 300. The first end 406 has a series of extensions 403 which are sized and positioned to fit within the apertures 204 of the sleeve 200 and to assist in aligning the sleeve 200 and the retainer 400 so that the channels (404 and 201) align. The series of extensions 403 align with the apertures 204 to lock the retainer 400 and the sleeve 200 together. In some embodiments, the retainer 400 and the sleeve 200 are a single component. A channel 401 extends from the first end 405 to the second 406 and is similar in size to the channel of the sleeve 201.

In the present embodiment, the sleeve 200 is connected to the retainer 400 via the apertures 204 and the extensions 403 to form an inner handle member with a channel which extends complete across the formed inner handle member. The housing 300 is fitted over the formed inner handle member. When the housing 300 is in a first position, the channel of the housing 300 and the channel of the inner handle member are aligned so a band can pass through the channel and into the hollow inner section of the inner handle member. A channel is formed from one end to the other of the inner handle member to allow the insertion of bands. The housing 300 is then rotated to a second position, where the release tab 203 engages with the channel of the housing 300 to "lock" the housing 300 in place, so that the channel of the inner handle member and the channel of the housing 300 are not aligned and a band cannot be removed from the exercise handle 100. This position does not allow the handle 300 to rotate until the release tab 203 is pressed in disengaging the release tab 203 from the channel of the housing 300, so that the user can now rotate the inner handle member (or the housing 300) to align the channels and remove the band.

Figure 7:
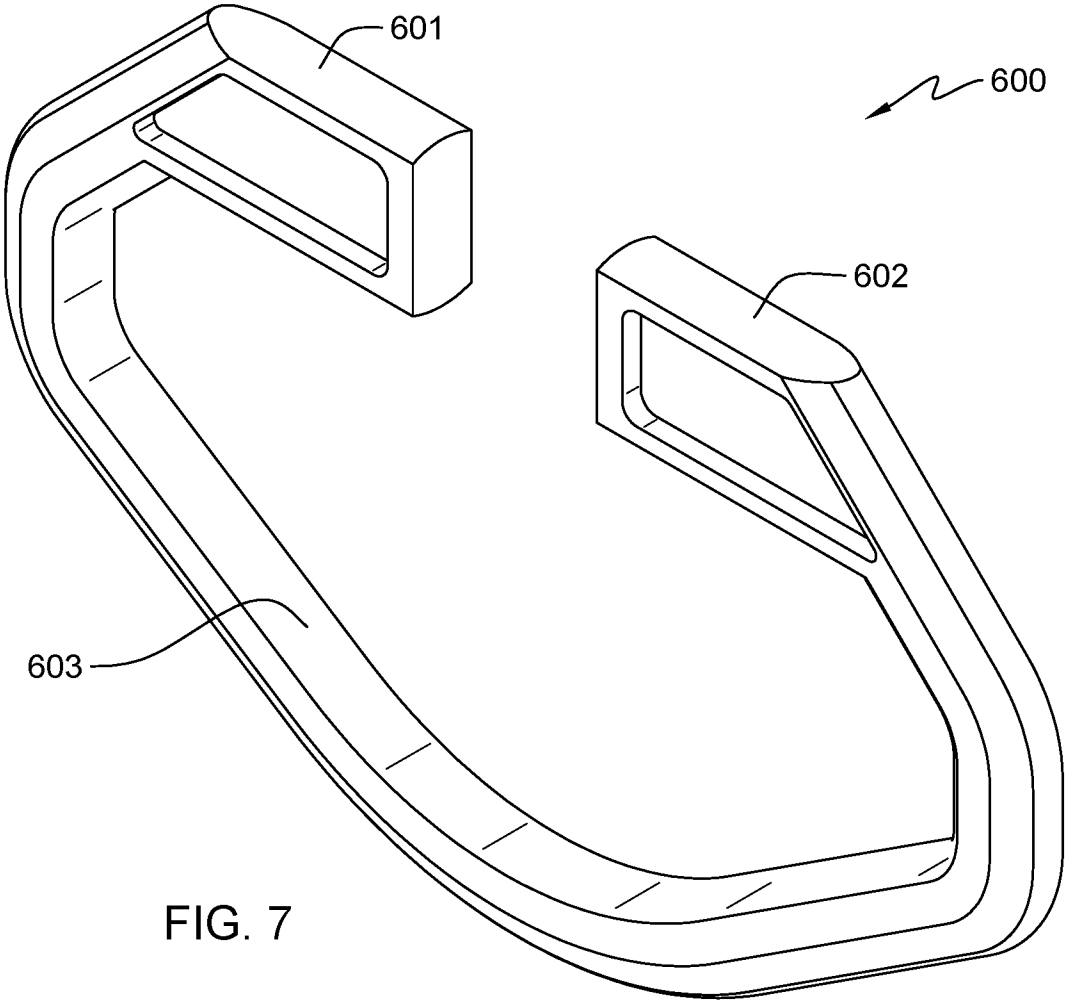
FIG. 7 depicts a view of a grip, in accordance with one embodiment of the present invention.

The grip 600 is designed to allow for bands which are too large to fit within the hollow inner portion of the exercise handle 100. As shown in FIG. 7, the grip 600 provides an extension to the exercise handle 100 where larger bands can be attached to the grip 600 and the grip is then secured within the exercise handle 100. As shown in FIG. 8, the band 800 has a diameter which is less than that of the exercise handle 100, and in some instances a user may want to use more than one band, or a band of a larger diameter and the grip 600 allows that band (or bands) to be used. Tabs 601 and 602 are sized to fit within the hollow inner portion of the exercise handle 100 and still permit the exercise handle 100 to lock, where the arm 603 of the grip is curved to follow the contour of the exercise handle 100 and extend out and away from the exercise handle 100 to provide adequate space for the bands and the user to hold the exercise handle 100.

The interior diameters of the sleeve 200, retainer 400, and the housing 300 are proportionate to one another, based on the intended size of the band 800 which is to be used with the handle 100, the interior diameters may be larger or smaller.

The components are made from, but not limited to polyethylene, polyethylene terephthalate, high-density polyethylene, polypropylene, polystyrene, polyvinyl chloride, polyurethane, poly carbonate, polybutylene terephthalate, acrylonitrile styrene acrylate, acrylics, aluminum, steel, cooper, various other metals, a combination of plastics and metals, or the like. In some embodiments, the handle 400 is extendable and retractable for adjustability to the length.

While this invention has been described in conjunction with the specific embodiments outlined above, it is evident that many alternatives, modifications and variations will be apparent to those skilled in the art. Accordingly, the preferred embodiments of the invention, as set forth above, are intended to be illustrative, not limiting. Various changes may be made without departing from the spirit and scope of this invention.

What is claimed is:

1. An exercise handle, comprising:

a housing having a slot extending from a first end to a second end and an internal cavity; and a sleeve having a slot extending from a first end to a second end and a locking tab extending from the first end, wherein the sleeve is within the housing, and is rotatable about a central axis of the housing and the locking tab is sized to fit within the slot of the housing.

2. The exercise handle of claim 1, wherein the locking tab of the sleeve and the slot of the sleeve are opposite one another.

3. The exercise handle of claim 1, where the housing is made from a material that is flexible.

4. The exercise handle of claim 1, wherein the housing and the sleeve have protruded first and second ends.

5. The exercise handle of claim 1, wherein the housing has textured surface.

6. The exercise handle of claim 1, wherein the locking tab is pressure sensitive.

* * * * *